US007671797B1

(12) United States Patent
Herz et al.

(10) Patent No.: US 7,671,797 B1
(45) Date of Patent: Mar. 2, 2010

(54) COORDINATE-BASED SYSTEM, METHOD AND COMPUTER PROGRAM PRODUCT FOR ADJUSTING AN ANTENNA

(75) Inventors: William S. Herz, Hayward, CA (US); Andrew C. Fear, Cedar Park, TX (US)

(73) Assignee: NVIDIA Corporation, Santa Clara, CA (US)

( * ) Notice: Subject to any disclaimer, the term of this patent is extended or adjusted under 35 U.S.C. 154(b) by 186 days.

(21) Appl. No.: 11/532,809

(22) Filed: Sep. 18, 2006

(51) Int. Cl.
*H01Q 3/00* (2006.01)

(52) U.S. Cl. ..... 342/359; 455/69

(58) Field of Classification Search ..... 342/359, 342/368–377; 455/69
See application file for complete search history.

(56) References Cited

U.S. PATENT DOCUMENTS

| | | | | |
|---|---|---|---|---|
| 4,674,873 | A * | 6/1987 | Zegarski | 356/138 |
| 5,625,668 | A * | 4/1997 | Loomis et al. | 455/456.5 |
| 5,760,739 | A * | 6/1998 | Pauli | 342/359 |
| 5,983,071 | A * | 11/1999 | Gagnon et al. | 342/359 |
| 6,208,315 | B1 * | 3/2001 | Kenmochi | 342/359 |
| 6,243,052 | B1 * | 6/2001 | Goldstein et al. | 343/895 |
| 6,268,826 | B1 * | 7/2001 | Schmidt et al. | 342/359 |
| 6,686,889 | B1 * | 2/2004 | Kwon et al. | 342/359 |
| 7,095,378 | B1 * | 8/2006 | Paquette | 343/757 |
| 2004/0244525 | A1 * | 12/2004 | Gaechter | 74/490.01 |
| 2005/0014533 | A1 * | 1/2005 | Cave et al. | 455/562.1 |
| 2005/0128137 | A1 * | 6/2005 | Lee et al. | 342/174 |
| 2005/0248486 | A1 * | 11/2005 | Lee et al. | 342/359 |
| 2006/0094449 | A1 * | 5/2006 | Goldberg | 455/456.6 |
| 2008/0018534 | A1 * | 1/2008 | Wu | 342/359 |
| 2008/0075021 | A1 * | 3/2008 | Rofougaran | 370/277 |

FOREIGN PATENT DOCUMENTS

| | | | |
|---|---|---|---|
| CN | 1761103 | A * | 4/2006 |
| DE | 10 2005 040 414 | | 3/2007 |
| JP | 05226920 | A * | 9/1993 |

OTHER PUBLICATIONS

U.S. Appl. No. 11/685,093, filed Mar. 12, 2007.
U.S. Appl. No. 11/766,935, filed Jun. 22, 2007.

* cited by examiner

*Primary Examiner*—Thomas H Tarcza
*Assistant Examiner*—Fred H Mull
(74) *Attorney, Agent, or Firm*—Zilka-Kotab, PC

(57) ABSTRACT

A system, method, and computer program product are provided. In use, a plurality of coordinates is identified. Further, at least one aspect of an antenna is adjusted based on the coordinates. In addition, the coordinates include source coordinates that indicate a location of a source of a signal received by the antenna. Additionally, the at least one aspect of the antenna is adjusted includes an orientation of the antenna, where the orientation is further determined based on a strength of the signal received by the antenna.

17 Claims, 5 Drawing Sheets

COORDINATE-BASED SYSTEM, METHOD AND COMPUTER PROGRAM PRODUCT FOR ADJUSTING AN ANTENNA

FIELD OF THE INVENTION

The present invention relates to antennas, and more particularly to techniques for adjusting antennas.

BACKGROUND

Traditionally, people have received television and/or radio broadcasts by way of satellite or radio services. Such services include satellite television (e.g. DirecTV, EchoStar, Dish Networks, etc.), Digital Video Broadcasting—Terrestrial (DVB-T), Advanced Television Systems Committee (ATSC) signals, FM/AM radio, etc. Currently, vehicles are also being equipped with satellite and high definition (HD) radios that receive such services directly into the vehicle.

One problem encountered by users of such services is that the receiver and related components (e.g. antenna, etc.) utilized for receiving a service are typically fixed and/or static in location or orientation, etc. Consequently, users have trouble receiving signals from a transmission source. For example, communication with the receiver may be blocked by any number of obstacles (e.g. physical objects, terrain, etc.).

Users may also encounter other problems such as interrupted service, or poor quality of service. By way of illustration, a satellite dish may be improperly aligned with the appropriate satellite orbit, or a TV antenna may be improperly aligned for a high definition television (HDTV) terrestrial broadcast.

In another example, a satellite or other "line of sight" signal radiators may not be adequately tracked while in a moving vehicle that utilizes such services, there may be multi-path interference patterns, there may be cross cancellation from other signals during peak hours of the day, and/or there may be multiple transmitter towers near a location such that the strongest signal is not readily identifiable.

There is thus a need for overcoming these and/or other problems associated with the prior art.

SUMMARY

A system, method and computer program product are provided. In use, a plurality of coordinates is identified. To this end, at least one aspect of an antenna may be adjusted based on the coordinates.

DETAILED DESCRIPTION

Figure 1:
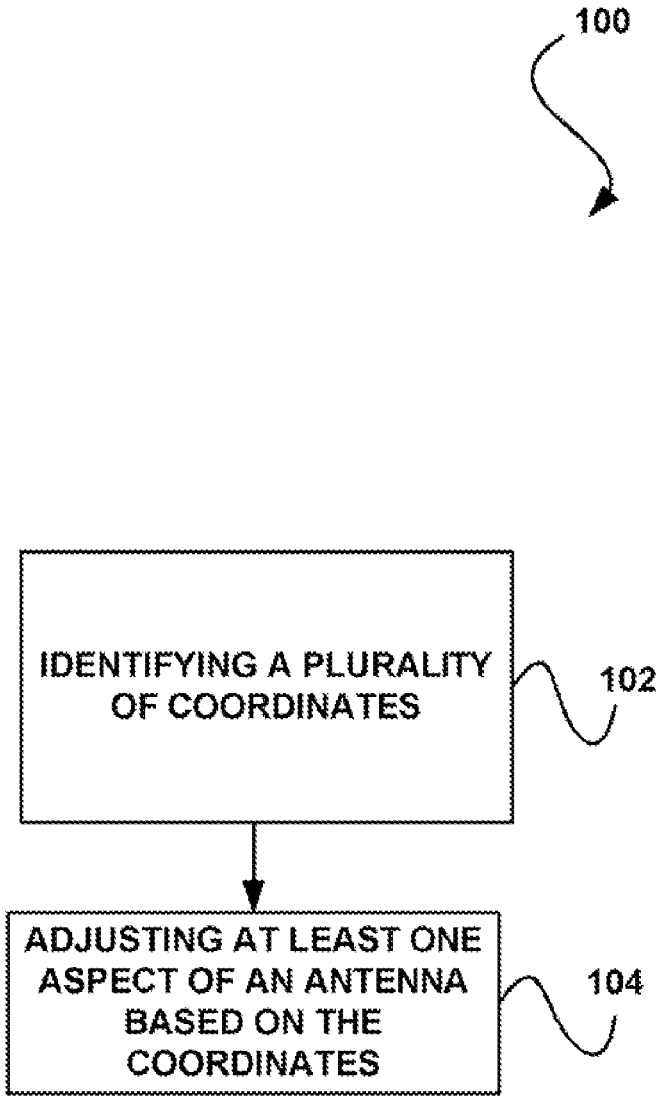
FIG. 1 shows a method for adjusting an antenna, in accordance with one embodiment.

FIG. 1 shows a method 100 for adjusting an antenna, in accordance with one embodiment. As shown in operation

102, a plurality of coordinates is identified. In the context of the present description, the coordinates may include any type of identifiers capable of identifying a location, at least in part. For example, in various embodiments, the coordinates may include any angle, tilt, elevation, location (e.g. latitude and/or longitude, etc.) identifiers, etc.

In one embodiment, the coordinates may include source coordinates that indicate a location of a source of a signal received by an antenna. Such signal may include, for example, a satellite signal (e.g. DirectTV, Dish Network, satellite television, satellite radio, etc.), a terrestrial broadcast signal (e.g. XM radio, SIRIUS radio, FM/AM radio signal, an ATSC signal, an analog TV broadcast signal, an HD radio signal, etc.), etc. Thus, the source of the signal may include a satellite, a broadcasting tower, etc.

Further, the antenna may include a satellite antenna, a terrestrial antenna and/or any other antenna capable of receiving a signal and having at least one aspect capable of being adjusted based on the coordinates, as will soon be set forth in greater detail. Thus, the antenna may be associated with and/or coupled to a receiver (e.g. mobile receiver, stationary receiver, etc.).

In another embodiment, the aforementioned coordinates may include antenna coordinates. Such antenna coordinates may indicate a location of an antenna. The antenna coordinates may be provided with respect to an antenna located on a mobile device (e.g. XM radio, cellular telephone, satellite receiver, etc.) and/or static device (e.g. home theatre, a PC equipped with a radio and/or TV tuner, etc.).

As an option, the coordinates may be identified utilizing a global positioning system (GPS). Thus, the coordinates may be identified automatically. As another option, the coordinates may be identified utilizing manual entry. Just by way of example, the coordinates may be identified by manual entry of an address. Such address may then be utilized to derive the coordinates.

As yet another option, the coordinates may be identified by downloading the coordinates. Still yet, the coordinates may be identified utilizing triangulation. Of course, however, the coordinates may be identified in any desired manner.

In still another embodiment, various extrapolation techniques may be employed. Just by way of example, first information may be used in combination with other information to calculate a location, etc. For example, if a GPS delivers current coordinates, but then becomes unavailable, other information (e.g. direction, velocity, etc.) may be used to extrapolate a current location. For that matter, any of the foregoing techniques may be used in any desired combination for identifying such location.

Moreover, at least one aspect of the antenna is adjusted based on the coordinates, as shown in operation 104. For example, in one embodiment, a single aspect of the antenna may be adjusted based on the coordinates. Of course, in other embodiments, a plurality of aspects of the antenna may be adjusted based on the coordinates.

For instance, the aspect may include an orientation of the antenna. Thus, the orientation of the antenna may be adjusted (e.g. moved, etc.) based on the coordinates. Just by way of example, the coordinates may indicate a location of a source providing a signal received or to be received by the antenna and/or a location of the antenna itself, such that the antenna may be moved for optimal alignment with and reception of the source signal. Of course, the antenna may be adjusted to receive a broadcast from the signal source based on the coordinates in any manner, by using the coordinates themselves and/or on any information derived from the coordinates (e.g. closest signal source, signal source with clearest reception, signal source with strongest available signal, etc.) and/or any information directly/indirectly derived therefrom.

In another embodiment, the aspect may include a wavelength received or to be received by the antenna. Thus, the antenna may be adjusted to receive an ultra high frequency (UHF), a very high frequency (VHF), or any other frequency (e.g. GHz, microwave, modulated or not, etc.) based on the coordinates. For example, if a tuner (e.g. radio, television, etc.) associated with the antenna is tuned to a particular channel that utilizes a particular frequency, the antenna may be adjusted to optimally receive such particular frequency.

In still another embodiment, in situations where the antenna includes multiple components (e.g. elements, etc.), such components may be selected, thereby adjusting the antenna to optimize reception, etc. For example, an antenna may include different components located in different positions or in different relative orientations (e.g. orthogonal, etc.). Still yet, a particular type (e.g. monopole, dipole, wavelength-specific type, etc.) of antenna (or component thereof) may be selected, as well as a length thereof, etc. Of course, additional embodiments may be provided where a particular geometry or other reception characteristic may be selected to optimize reception. Further, based on any of the aforementioned input, such components or aspects thereof may be selected to optimize reception during use.

Of course, it should be noted that any desired aspect of the antenna may be adjusted based on the coordinates in any desired manner. In this way, statically located and/or dynamically located antennas may be adjusted to provide optimal reception.

More illustrative information will now be set forth regarding various optional architectures and features of different embodiments with which the foregoing method 100 may or may not be implemented, per the desires of the user. It should be strongly noted that the following information is set forth for illustrative purposes and should not be construed as limiting in any manner. Any of the following features may be optionally incorporated with or without the exclusion of other features described.

Figure 2:
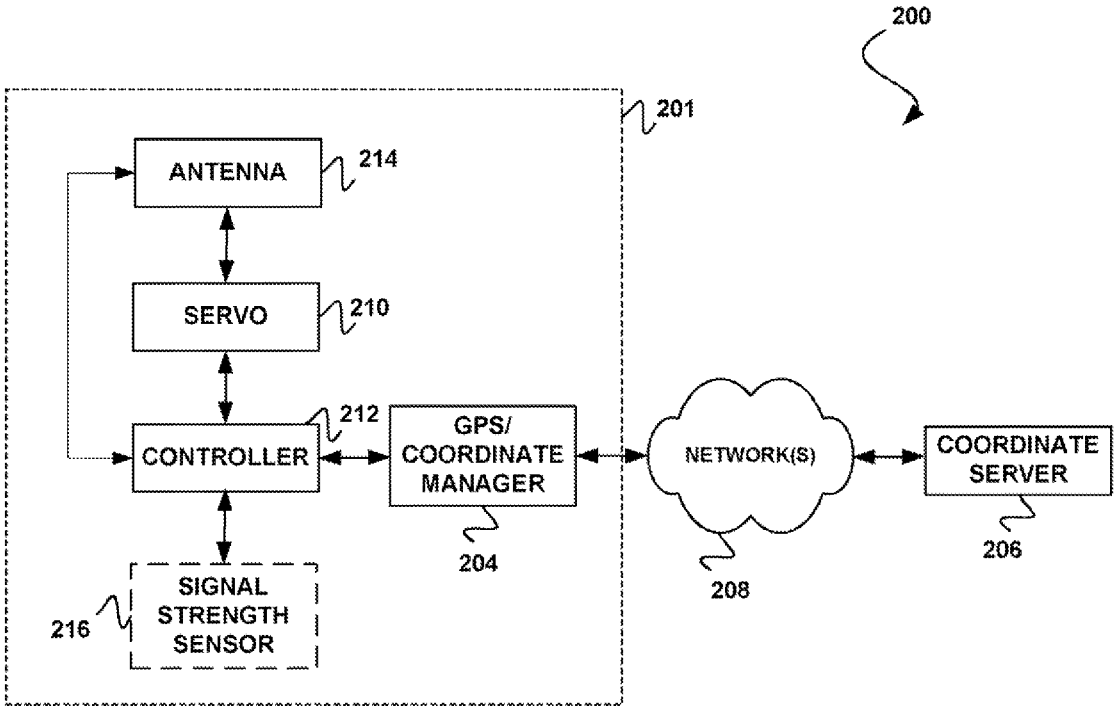
FIG. 2 shows a system for adjusting an antenna, in accordance with another embodiment.

FIG. 2 shows a system 200 for adjusting an antenna, in accordance with another embodiment. As an option, the system 200 may be implemented to carry out the functionality of the method 100 of FIG. 1. Of course, however, the system 200 may be carried out in any desired environment. Further, the aforementioned definitions may equally apply to the description below.

As shown, a receiving system 201 is connected to at least one network 208. The network(s) may include any network(s) capable of communicating data. One example of such a network(s) will be described in more detail with respect to FIG. 4.

By way of the network(s) 208, the receiving system 201 may be connected to a coordinate server 206. In one embodiment, the coordinate server 206 may provide source coordinates to the receiving system 201. Just by way of example, the coordinate server 206 may provide coordinates associated with a location of at least one source capable of broadcasting a signal to the receiving system 201.

In other embodiments, the coordinate server 206 may further include a look-up table or the like for providing data associated with the coordinates. Just by way of example, the data may include environment data. Such environment data may include natural terrain characteristics, such as hills, water, etc. The environment data may also include manmade terrain characteristics, such as buildings, bridges, etc. In the case of both natural and manmade terrain characteristics, the aforementioned data may further describe any known or calculated reflection surfaces which may at least potentially interfere with proper receipt of a signal.

Still yet, the environment data may further include weather patterns capable of affecting a signal from an associated source. Such weather patterns may include severe winds, storms, etc. As a further option, the environment data may include a time of day (e.g. day, night, etc.), and/or a change in radiated power, directional "footprint," and/or any other antenna-related aspect mentioned earlier, that is under a broadcaster's control (to prevent interference with other channels, etc.). Of course, however, it should be noted that the environment data may include any other data capable of being associated with an environment associated with the antenna coordinates, the source signal coordinates, and/or any coordinates therebetween.

As another option, source coordinates within the coordinate server 206 may be updated during use. In various embodiments, the source coordinates may be updated automatically and/or manually. For example, the source coordinates may be updated with coordinates (e.g. new source coordinates, modified source coordinates, deleted source coordinates, etc.), as appropriate. The source coordinates may also be updated with new and/or modified terrain characteristics. Still yet, the source coordinates may be updated with new and/or modified weather patterns, etc. To this end, the receiving system 201 may be updated with the above described source coordinates and related data in real time, on demand, on a periodic basis, using push/pull technology, when new information is available, etc., as desired.

In addition, a GPS/coordinate manager 204 may be included in the receiving system 201. The GPS/coordinate manager 204 may be utilized for identifying antenna coordinates associated with an antenna 214 of the receiving system 201. In one embodiment, the antenna coordinates may include coordinates describing a location of the antenna 214.

In use, the GPS/coordinate manager 204 may receive the source coordinates from the coordinate server 206 by way of the network 208 via the update operation described earlier. Further, the GPS/coordinate manager 204 may communicate such source coordinates and/or the antenna coordinates to a controller 212 of the receiving system 201.

As an option, a signal strength sensor 216 may also be included in the receiving system 201. The signal strength sensor 216 may detect and/or identify signal data, including a strength of a signal received by the receiving system 201 utilizing the antenna 214. Thus, the signal strength sensor 216 may identify whether a signal received by the receiving system 201 is strong, weak, interrupted, etc. The signal strength sensor 216 may also communicate signal data describing the signal to the controller 212. As an option, such signal data may also include other information (e.g. frequency, strength, gradient, etc.) associated with the signal. In various embodiments, this and any other information may be communicated to the server 206 so that it can be fed back and correlated, aggregated, etc. for use in tuning a system inclusive of multiple antennas, etc.

To this end, the controller 212 may include logic for processing the source coordinates (and any related environmental data, etc.), the antenna coordinates, and/or the signal data. In particular, the controller 212 may determine an optimal orientation or any other aspect of the antenna 214 based on such input. Such orientation, etc. may be determined in any desired manner, examples of which will be set forth hereinafter in greater detail.

Just by way of example, the controller 212 may determine the optimal orientation of the antenna 214 based on natural or manmade terrain (e.g. located between the location of the antenna and the location of the source, etc.). In particular, the desired orientation may be achieved by positioning the antenna such that hills or buildings do not obstruct a signal broadcasted from a source to a device associated with the receiving system 201.

In additional embodiments, the optimal orientation may also be based on anticipated reflections. For example, the orientation may be positioned to avoid water and/or building reflections that may adversely affect a signal. Still yet, the orientation may be based on a time of day, such that signals optimally received at night are received during the nighttime, signals optimally received during the day are received during the daytime, etc.

In the context of an additional example of use, the controller 212 may determine the orientation of the antenna 214 based on a strength of a signal received by the antenna 214 utilizing the signal data. The orientation may also be determined based on a frequency of a signal received by the antenna 214. Of course, the orientation may be based on any combination of the above described factors. Further, various embodiments may employ a continuous or periodic feedback associated with any of the foregoing input to repeatedly tune the orientation or other aspect of the antenna 214. Such feature may also be used in a situation where any of the input parameters are changing over time.

The antenna 214 may thus be adjusted to the orientation determined by the controller 214. In one embodiment, the antenna 214 may be adjusted utilizing a servo 210 with 2-D or 3-D rotational/linear movement capabilities. Of course, any device capable of adjusting (e.g. moving, selecting components, etc.) the antenna 214 and/or controlling the signal strength meter may be used in other embodiments.

In various applications, the receiving system 201 may be integrated within any device capable of receiving a signal. For example, the receiving system 201 may be integrated within a satellite dish, a mobile device (e.g. XM radio, cellular phone, etc.), etc. The receiving system 201 may also be an intermediate device between an output device (e.g. radio, television, etc.) and the antenna 214. As a further option, the display device may display information regarding the positioning of the antenna 214. Of course, other embodiments are contemplated which employ audio cues regarding antenna positioning or other antenna information.

In one exemplary embodiment where the receiving system 201 is associated with a mobile device (e.g. XM radio device, etc.), it may adjust the antenna 214 based on coordinates of the antenna and/or coordinates of a source broadcasting to the mobile device. In particular, since the mobile device may be constantly moving, the antenna 214 may be adjusted based on any movements to connect to a closest broadcasting source and/or a broadcasting source with a strongest signal. In this way, the mobile device may continuously and automatically ensure an optimal connection with a broadcasting source. For instance, in a bi-directional example involving a cellular phone, an intelligent decision may be made as to which tower to communicate with, etc.

In another exemplary embodiment where the receiving system 201 is associated with a static device (e.g. a satellite dish, etc.), it may adjust the antenna 214 based on coordinates of the antenna and/or coordinates of a source broadcasting to the static device. In particular, the antenna 214 may be adjusted based on changing environmental factors (e.g. terrain, time of day, frequency associated with channel, etc.) in order to ensure an optimal connection with a broadcasting source.

Figure 3:
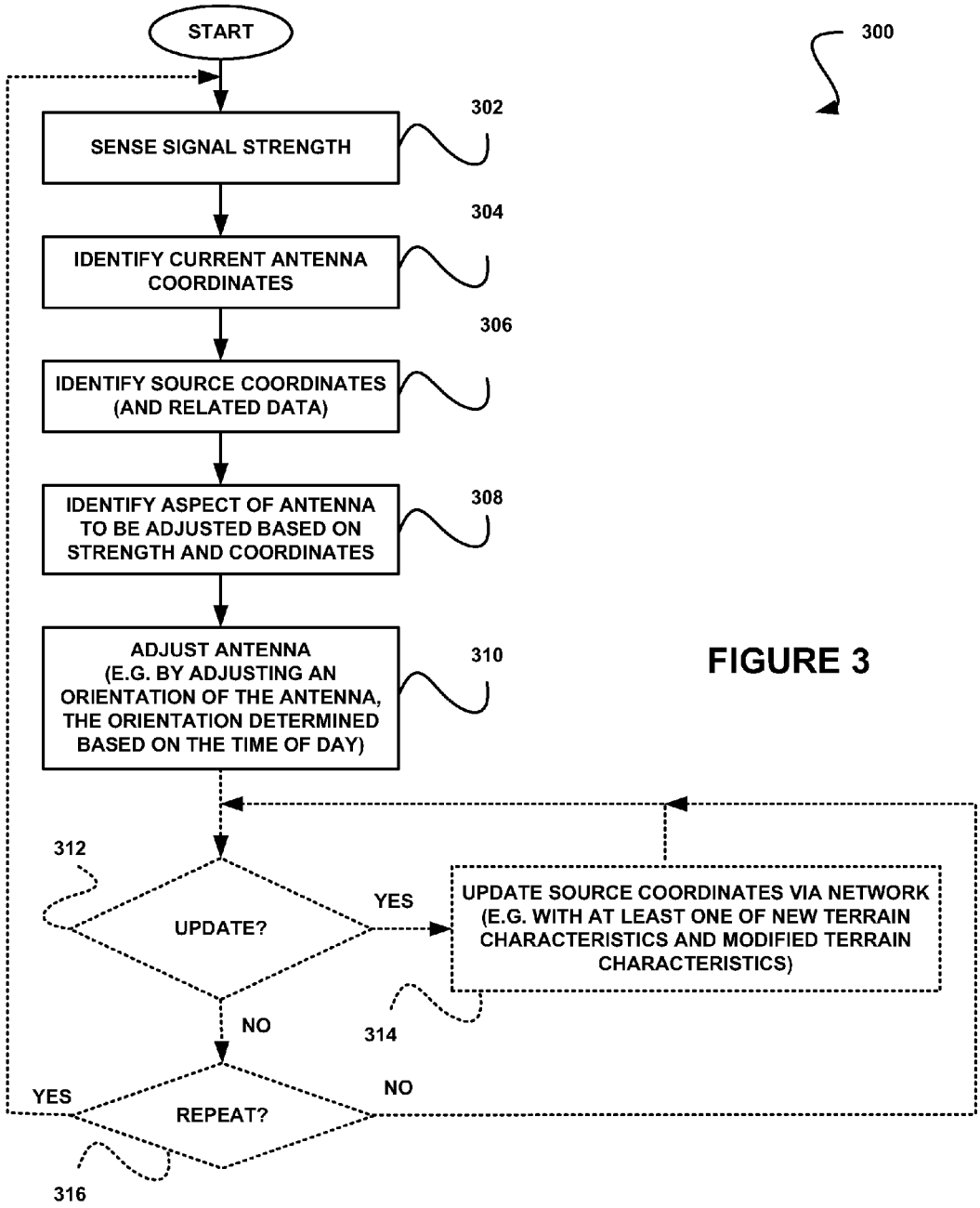
FIG. 3 shows a method for adjusting an antenna utilizing signal strength and location coordinates, in accordance with yet another embodiment.

FIG. 3 shows a method 300 for adjusting an antenna utilizing signal strength and location coordinates, in accordance with yet another embodiment. As an option, the method 300 may be implemented in the context of the details of FIGS. 1 and/or 2. Of course, however, the method 300 may be carried out in any desired environment. Further, the aforementioned definitions may equally apply to the description below.

As shown in operation 302, a signal strength is sensed. The signal strength may be sensed based on a signal received by an antenna. The signal strength may be sensed utilizing a signal strength sensor, such as that described above with respect to FIG. 2.

Current antenna coordinates are also identified, as shown in operation 304. Such current antenna coordinates may be identified utilizing a GPS and/or any other system capable of identifying coordinates of the antenna. Additionally, as shown in operation 306, source coordinates are identified. The source coordinates may include a location of a source from which the antenna receives a broadcast signal. In some embodiments, the source coordinates may also include locations of a plurality of sources from which a particular broadcast may be received by the antenna.

As mentioned earlier, the source coordinates may also include environment data associated with a location of the source. For example, the source coordinates may be supplemented by terrain data, weather pattern data, etc. The source coordinates may also be supplemented by frequency data, including the signal strength of transmissions of a particular frequency associated with the source, etc.

An optimal antenna adjustment may then be determined based on the input of operations 302-306, as shown in operation 308. In one embodiment, such adjustment may be determined via a look-up table that maps various input values, etc. and combinations thereof to specific adjustments. In various embodiments, such information may be remotely stored for local retrieval and/or locally stored for local use/remote use, etc. Of course, in other embodiments, such adjustments may also be calculated in real time using appropriate directional algorithms, etc. For example, in such latter embodiments, weights may be given to the signal strength, the current antenna coordinates, and any data associated with the source coordinates. To this end, a combination of differently weighted inputs may be used to determine the optimal antenna adjustment.

Next, the antenna may be adjusted in operation 308. See operation 310. The antenna may be adjusted utilizing any desired device. For example, as described above with respect to FIG. 2, the antenna may be adjusted utilizing a servo. Further, in situations where the antenna includes multiple components, such components may be selected, thereby adjusting the antenna to optimize reception, etc. Of course, any aspect of the antenna may be adjusted in any desired manner.

Strictly as an option, it may be determined whether an update to the source coordinates (and/or any other related data) is available, as shown in decision 312. The decision may be made periodically, based on a predetermined time period, for example. Of course, however, the decision may be made in any desired manner and at any time. If it is determined that an update is available, the source coordinates (and/or any other related data) may be updated utilizing a network, as shown in operation 314. In one embodiment, this may be accomplished utilizing a server similar to that set forth during reference to FIG. 2.

As yet another option, it may then be determined whether to adjust the antenna again, as shown in decision 316. The decision 316 may be made based on any desired criteria (e.g.

periodically, on-demand, etc). For example, the decision may be made based on a detection of a change in signal strength, a change in current antenna coordinates, a change in source coordinates, or change in any other factor that may impact the optimal antenna adjustment. In this way, the antenna may be continuously and automatically adjusted to ensure optimal connection with a broadcasting source.

Figure 4:
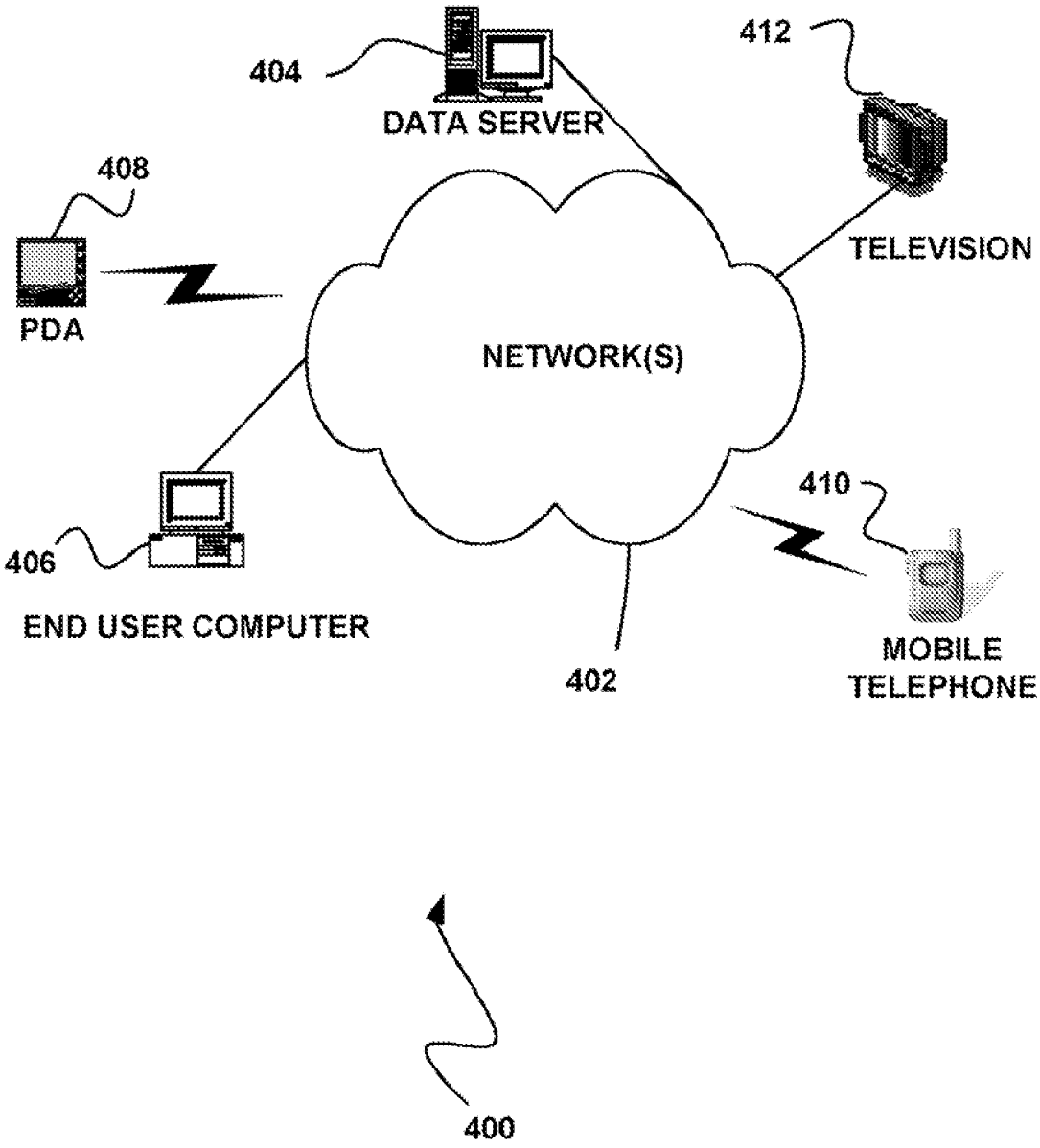
FIG. 4 illustrates a network architecture, in accordance with still yet another embodiment.

FIG. 4 illustrates a network architecture 400, in accordance with still yet another embodiment. As an option, the network architecture 400 may be implemented to incorporate the framework and/or functionality of FIGS. 1-3. As shown, at least one network 402 is provided. In the context of the present network architecture 400, the network 102 may take any form including, but not limited to a telecommunications network, a local area network (LAN), a wireless network, a wide area network (WAN) such as the Internet, peer-to-peer network, cable network, etc. While only one network is shown, it should be understood that two or more similar or different networks 402 may be provided.

Coupled to the network 402 is a plurality of devices. For example, a server computer 404 and an end user computer 406 may be coupled to the network 402 for communication purposes. Such end user computer 406 may include a desktop computer, lap-top computer, and/or any other type of logic. Still yet, various other devices may be coupled to the network 402 including a personal digital assistant (PDA) device 408, a mobile phone device 410, a television 412, a set-top box (not shown), etc. Each of such devices may be optionally equipped with an antenna and related components similar to those set forth hereinabove during the description of previous figures.

Figure 5:
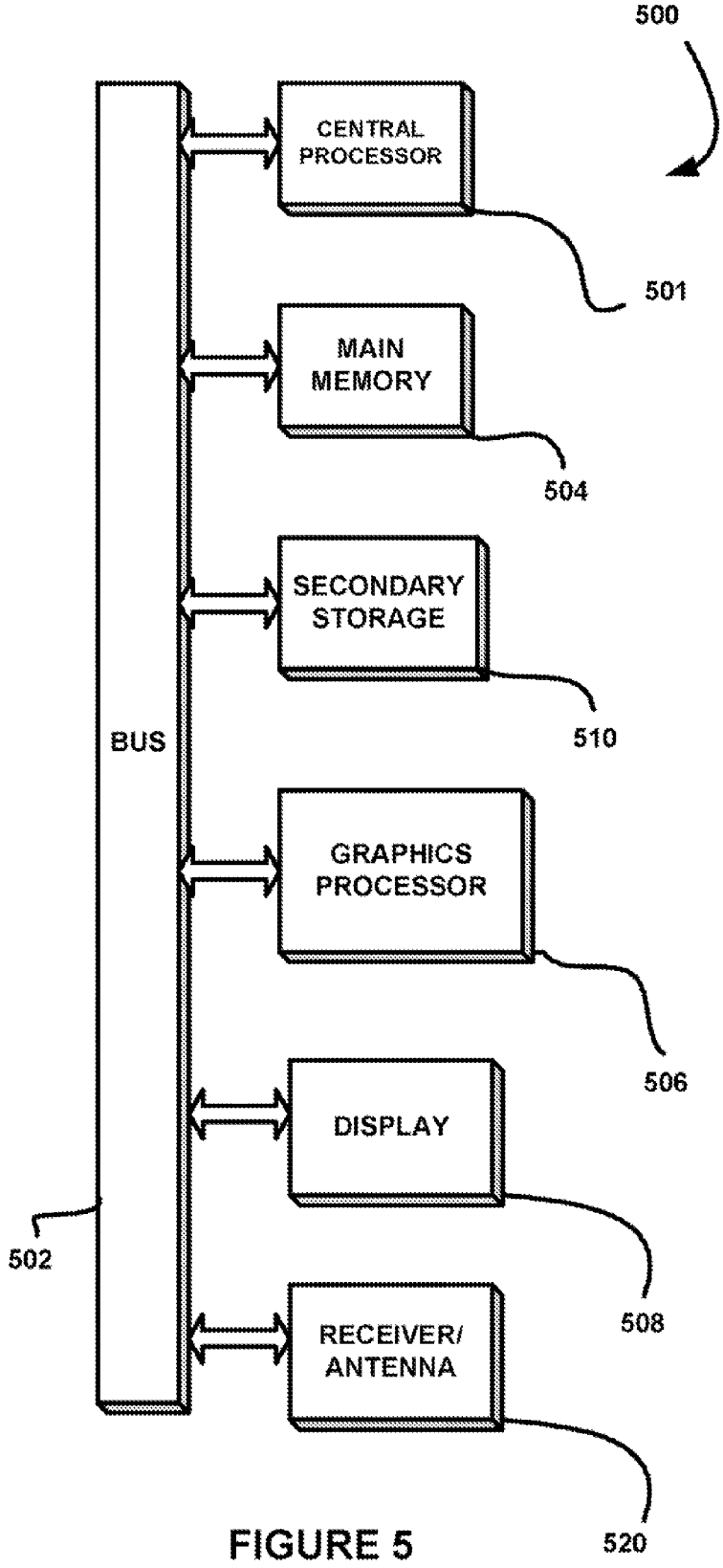
FIG. 5 illustrates an exemplary system, in accordance with yet another embodiment.

FIG. 5 illustrates an exemplary system 500, in accordance with yet another embodiment. As an option, the system 500 may be implemented in the context of any of the devices of the network architecture 400 of FIG. 4. Of course, the system 500 may be implemented in any desired environment.

As shown, a system 500 is provided including at least one central processor 501 which is connected to a communication bus 502. The system 500 also includes main memory 504 [e.g. random access memory (RAM), etc.]. The system 500 also includes a graphics processor 506 and a display 508.

The system 500 may also include a secondary storage 510. The secondary storage 510 includes, for example, a hard disk drive and/or a removable storage drive, representing a floppy disk drive, a magnetic tape drive, a compact disk drive, etc. The removable storage drive reads from and/or writes to a removable storage unit in a well known manner.

Computer programs, or computer control logic algorithms, may be stored in the main memory 504 and/or the secondary storage 510. Such computer programs, when executed, enable the system 500 to perform various functions. Memory 504, storage 510 and/or any other storage are possible examples of computer-readable media.

Still yet, a receiver and associated antenna 520 may further be connected to the communication bus 502. Such antenna 520 may be equipped with related components similar to those set forth hereinabove during the description of previous figures. To this end, at least one aspect of the antenna 520 may be adjusted based on coordinates.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A computer-implemented method, comprising:

identifying a plurality of coordinates; and adjusting at least one aspect of an antenna based on the coordinates;

wherein the coordinates include source coordinates indicating a location of a source of a signal received by the antenna;

wherein the source coordinates are updated utilizing a network by communicating an updated set of source coordinates over the network for use in place of a previous set of source coordinates;

wherein the at least one aspect of the antenna that is adjusted includes an orientation of the antenna;

wherein the orientation is further determined based on a strength of the signal received by the antenna and a time of day.

2. The method of claim 1, wherein the coordinates include antenna coordinates indicating a location of the antenna.

3. The method of claim 1, wherein the coordinates are identified utilizing a global positioning system.

4. The method of claim 1, wherein the coordinates are identified utilizing manual entry.

5. The method of claim 1, wherein the orientation is further determined based on an environment of the antenna.

6. The method of claim 5, wherein the environment of the antenna includes natural or manmade terrain.

7. The method of claim 5, wherein the orientation is further determined based on anticipated reflections associated with the environment of the antenna.

8. The method of claim 1, wherein the orientation is determined utilizing a look-up table.

9. The method of claim 1, wherein the orientation is further determined based on a frequency of the signal received by the antenna.

10. The method of claim 1, wherein the orientation is adjusted utilizing a servo.

11. The method of claim 1, wherein the antenna is coupled to a mobile receiver.

12. The method of claim 1, wherein at least one of a plurality of elements of the antenna is adjusted based on the coordinates.

13. The method of claim 1, wherein the antenna includes at least one of a satellite antenna and a terrestrial antenna.

14. The method of claim 1, wherein the identifying of the coordinates includes utilizing a manually entered address to derive the coordinates.

15. A computer program product embodied on a computer readable medium, comprising:

computer code for identifying a plurality of coordinates; and computer code for adjusting at least one aspect of an antenna based on the coordinates;

wherein the computer program product is operable such that the coordinates include source coordinates indicating a location of a source of a signal received by the antenna;

wherein the computer program product is operable such that the source coordinates are updated utilizing a network by communicating an updated set of source coordinates over the network for use in place of a previous set of source coordinates;

wherein the computer program product is operable such that the at least one aspect of the antenna that is adjusted includes an orientation of the antenna;

wherein the computer program product is operable such that the orientation is further determined based on a strength of the signal received by the antenna and a time of day.

16. A system, comprising:

a controller for adjusting at least one aspect of an antenna based on a plurality of coordinates;

wherein the system is operable such that the coordinates include source coordinates indicating a location of a source of a signal received by the antenna;

wherein the system is operable such that the source coordinates are updated utilizing a network by communicating an updated set of source coordinates over the network for use in place of a previous set of source coordinates;

wherein the system is operable such that the at least one aspect of the antenna that is adjusted includes an orientation of the antenna;

wherein the system is operable such that the orientation is further determined based on a strength of the signal received by the antenna and a time of day.

17. A computer-implemented method, comprising:

identifying a plurality of coordinates; and adjusting at least one aspect of an antenna based on the coordinates;

wherein the coordinates include source coordinates indicating a location of a source of a signal received by the antenna;

wherein the source coordinates are updated utilizing a network by communicating an updated set of source coordinates over the network for use in place of a previous set of source coordinates;

wherein the at least one aspect of the antenna that is adjusted includes an orientation of the antenna;

wherein the orientation is further determined based on a strength of the signal received by the antenna;

wherein the source coordinates are updated with at least one of new terrain characteristics and modified terrain characteristics.

* * * * *